US008393751B2

(12) United States Patent
Qiu

(10) Patent No.: US 8,393,751 B2
(45) **Date of Patent: *Mar. 12, 2013**

(54) FLASH LIGHT WITH ADJUSTABLE LIGHT ARRANGEMENT

(75) Inventor: Fujun Qiu, Ningbo (CN)

(73) Assignee: Ningbo Futai Electric Limited, Ningbo, Zhejiang (CN)

( * ) Notice: Subject to any disclaimer, the term of this patent is extended or adjusted under 35 U.S.C. 154(b) by 817 days.

This patent is subject to a terminal disclaimer.

(21) Appl. No.: 12/586,132

(22) Filed: Sep. 16, 2009

(65) Prior Publication Data

US 2011/0063823 A1 Mar. 17, 2011

(51) Int. Cl.
*F21L 4/04* (2006.01)

(52) U.S. Cl. ..... 362/203; 362/188; 362/202; 362/208

(58) Field of Classification Search ..... 362/188, 362/202, 203, 208
See application file for complete search history.

(56) References Cited

U.S. PATENT DOCUMENTS 1,674,650 A * 6/1928 Leser ..... 362/188
7,083,299 B2 * 8/2006 Chapman ..... 362/188

* cited by examiner

*Primary Examiner* — Mary Ellen Bowman
(74) *Attorney, Agent, or Firm* — Raymond Y. Chan; David and Raymond Patent Firm

(57) ABSTRACT

A flash light includes a housing having a front end and a rear end to define a fixed length from the front to rear end. The housing further has a light cavity and a power cavity for receiving power source. The light arrangement includes a lens disposed at the front end of the housing, a light source disposed within the light cavity, and a light adjustor movably coupling with the housing to selectively adjust a distance between the lens and the light source along a longitudinal axis direction of the housing for adjusting the illumination angles of the light beam without altering the fixed length of the housing. The flash light is adapted for selectively adjusting illumination angles to provide variety of light patterns.

10 Claims, 4 Drawing Sheets

FLASH LIGHT WITH ADJUSTABLE LIGHT ARRANGEMENT

BACKGROUND OF THE PRESENT INVENTION

1. Field of Invention

The present invention relates to a flash light apparatus, and more particularly to a flash light apparatus with adjustable light arrangement, which is able to selectively adjust the focus of a light source emitting from a lens of the flash light apparatus with a fixed length of the housing.

2. Description of Related Arts

Flash light is commonly used in many emergency situations or dark environments. It is portable and can be used in many different places for many reasons. For examples, when the police man is on duty at night and passing through a sparsely populated area, he/she needs temporarily illuminate the area for searching; when people go camping or hiking, the flash light device is one of the indispensable equipments to assist them find a way out under the weak or dark light.

Traditionally, the flash light has a fix light intensity and specific pattern, so that the user has to choose one flash light for one purpose, such as the flash light which is able to gather the light for focus on a relatively smaller area for higher light intensity. The user may choose another flash light which is able to illuminate a longer distance and wider range of the environment. It is inconvenient if the flash light has only one illuminating pattern. For instance, a hiker carrying the fixed light pattern flash light can not efficiently adjust the flash light to focus on the near sight object to prevent being tripped by the object, or adjust the flash light to illuminate the far sight to check out the environment for safety purpose.

Therefore, in order to meet the requirement for using the flash light in variety situations, an adjustably focus between the lens and the light source of the flash light is invented for providing a plurality of light pattern, so that the flash light is able to selectively illuminate both of the near and far sight, or choose light emitting angle projected through the lens of the flash light. The most common flash light with selectively adjustable light pattern is through adjusting the position of the lens in responsive to the fixed location of the light source, so as to provide a variety of focus. The light patterns of the flash light are generated in responsive to the distances between the lens and the light source. Thus, the distance between the lens and the light source are to normally adjusted via rotating a front end portion of the flash light to rotatably move the lens away from or closer to the light source, so as to generate the variety of light patterns.

However, the overall length of the flash light is longer after the lens at the front end portion of the flash light is rotatably moved away from the light source, so that the flash light may not be able to fit into the original pocket or compartment for storing the flash light, such as packing up the flash light into the compartment of a gun set worn by the policemen. In order to store the flash light into the bag or compartment and minimize the overall size of the flash light, the front end portion of the flash light usually has to be rotated to a minimized distance between the lens and the light source, so that the flash light can be stored. When the user, such as hiker, policemen, or solider takes out the flash light for illumination, the user has to rotatably re-adjust the focus of the lens and the light source to a predetermined distance, so as to select the light pattern the user desired or needed.

SUMMARY OF THE PRESENT INVENTION

A main object of the present invention is to provide a flash light with adjustable light arrangement for providing a plurality of illumination angles. Meanwhile, the total length of the flash light housing is remaining the same.

Another object of the present invention is to provide a flash light with adjustable light arrangement, wherein the adjustor is able to selective adjust a distance between the light source and the lens without altering the fixed length of the housing.

Another object of the present invention is to provide a flash light with adjustable light arrangement, wherein the illumination angle of the light beam can be selectively adjusted via adjusting the focus of the lens and the light source through reciprocatingly moving the light source toward or away from the lens, so as to minimize the overall length of the flash light.

Another object of the present invention is to provide a flash light with adjustable light arrangement, wherein the lens is a convex lens, so that the light beam projected from the light source through the lens is able to have a maximized projecting angle.

Another object of the present invention is to provide a flash light with adjustable light arrangement, wherein the conductive holder and tubular conductor effectively ensure the light source electrically contacting with the power source when the light source is being reciprocatingly moved toward or away from the light source.

Another object of the present invention is to provide a flash light with adjustable light arrangement, wherein the lens is affixed at the front end portion of the flash light, so that the lens can be able to completely seal the housing of the flash light apparatus, so as to provide the water proof and dust proof function.

Accordingly, in order to accomplish the above objectives, the present invention provides a flash light apparatus with adjustable LED arrangement, comprising a hollow housing and a light arrangement.

The hollow housing has a front end and a rear end to define a fixed length from the front end to the rear end, a light cavity formed within the front end, and a power cavity formed within the rear end for receiving a power source within the power cavity.

The light arrangement comprises:

a lens coaxially supported at the front end of the housing, a light source, which is LED, being disposed within the light cavity for generating a light beam alignedly toward the lens, and an adjustor movably coupling with the housing to selectively adjust a distance between the lens and the light source along a longitudinal axis direction of the housing, so as to selectively adjust an illumination angle of the light beam without altering the fixed length of the housing.

These and other objectives, features, and advantages of the present invention will become apparent from the following detailed description, the accompanying drawings, and the appended claims.

DETAILED DESCRIPTION OF THE PREFERRED EMBODIMENT

Figure 1:
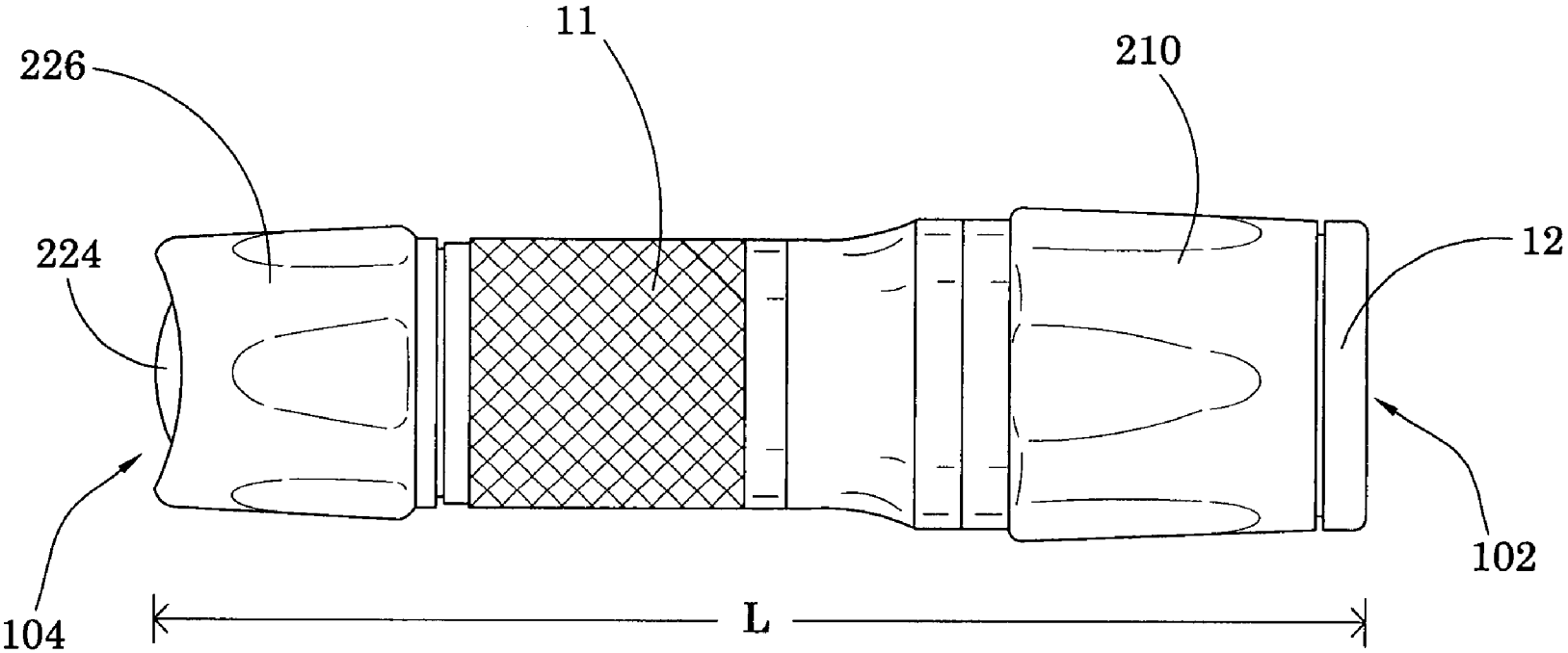
FIG. 1 is a side view of a flash light apparatus according to a preferred embodiment of the present invention.
Figure 2:
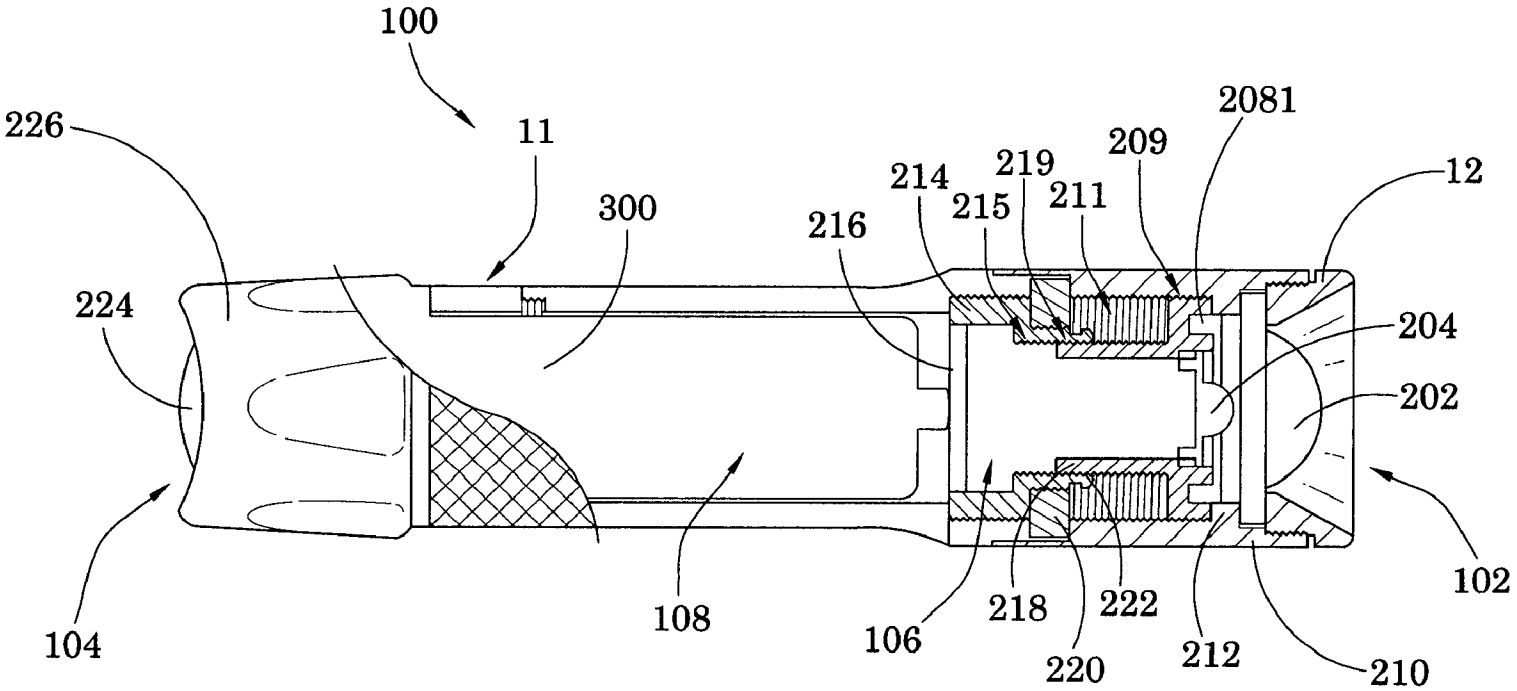
FIG. 2 is a side sectional view of the flash light apparatus according to the preferred embodiment of the present invention.

Referring to FIGS. 1 and 2 of the drawings, a flash light according to a preferred embodiment of the present invention is illustrated, wherein the flash light comprises a hollow housing 100 and a light arrangement 200.

The housing 100 has an open front end 102 and a closed rear end 104 to define a fixed length L between the front end 102 and the rear end 104. The housing 100 further has a light cavity 106 formed at the front end 102 of the housing 100 and a power cavity 108 formed at the rear end 104 for receiving a power source 300, which is electrically linked to the light arrangement 200.

The light arrangement 200 comprises a lens 202, a light source 204 disposed within the light cavity 106, and a light adjustor 206. The lens 202 is coaxially supported at the front end 102 of the housing 100. The light source 204, preferably a LED, is disposed within the light cavity 106 within the light cavity 106 of the housing 100 for generating a light beam alignedly toward the lens 202. The light adjustor 206 is movably coupling with the housing 100 to selectively adjust a distance between the light source 204 and the lens 202 along a longitudinal axis of the housing 100 for adjusting an illumination angle of the light beam without altering the fixed length L of the housing 100.

According to the preferred embodiment, the lens 202 of the light arrangement is preferably a resin convex lens to seal and affix at the front end 102 of the housing 100, such that the convex lens 202 is able to provide a relatively wider range of the illumination angle to illuminate a larger area when the distance between the lens 202 and the light source 204 is minimized. The lens 202 may be made by the resin material to form a durable optical resin lens 202 with high light transmitting property. It is worth to mention that the light source 204 is preferably LED due to the benefit of high intensity and low power requirement thereof. The light source 204 may also be a traditional light bulb or any other light sources which can be applied on the flash light.

Figure 3:
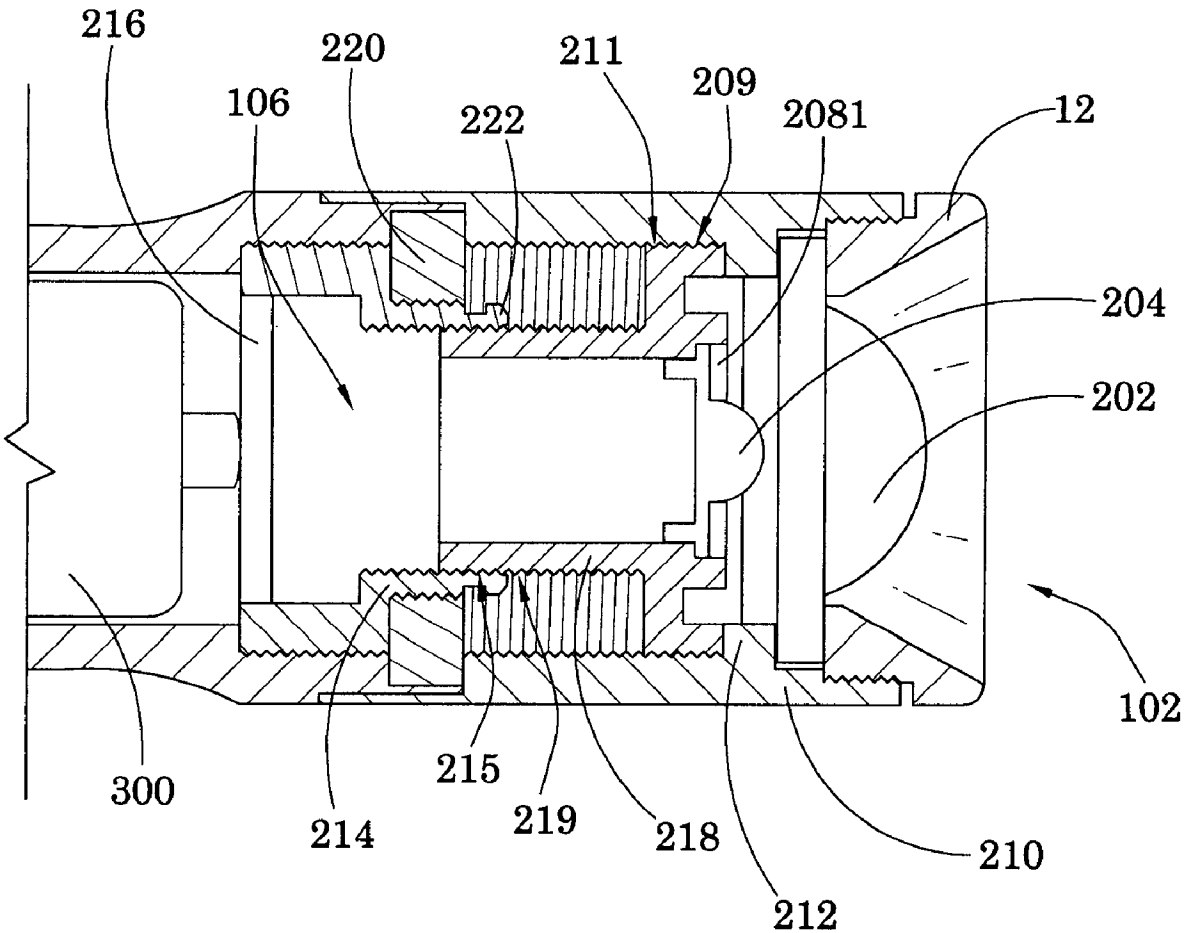
FIG. 3 is a partially sectional view of the flash light apparatus according to the preferred embodiment of the present invention, illustrating the light source being moved at a forward position close to the lens.
Figure 4:
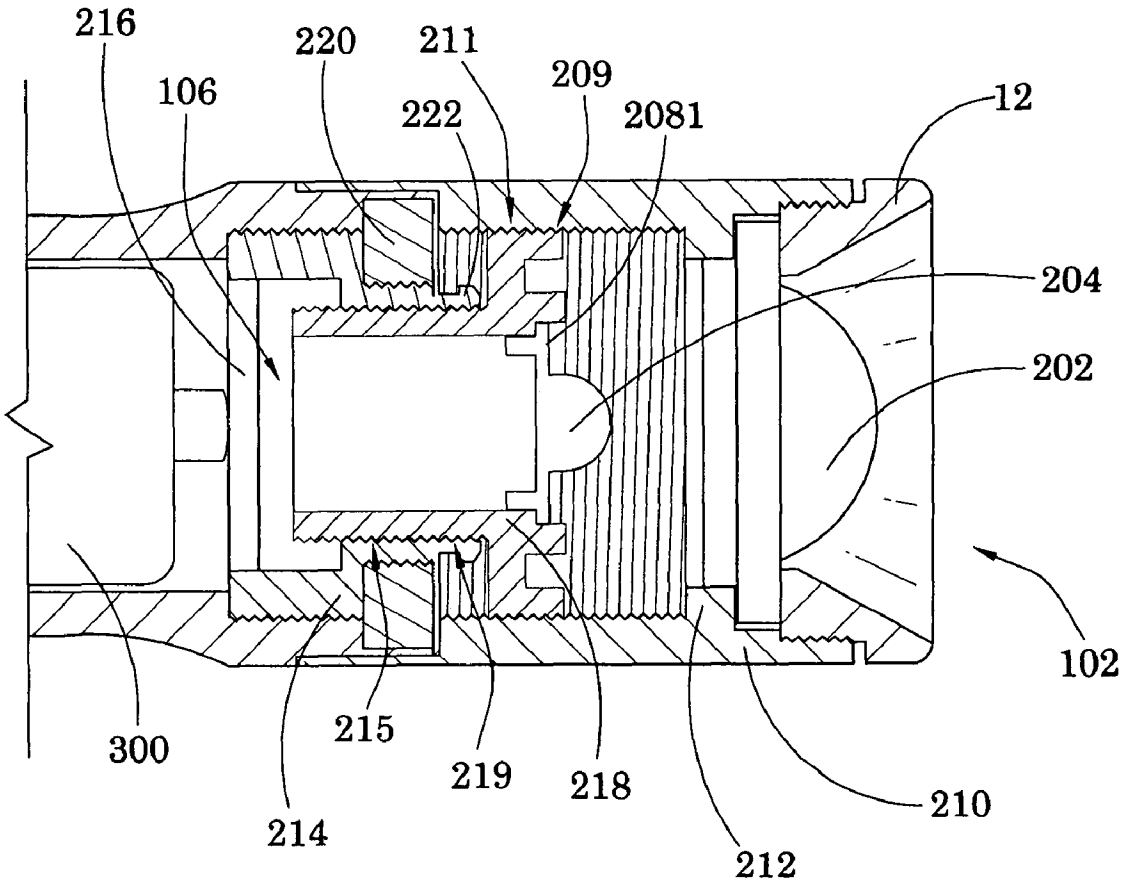
FIG. 4 is another partially sectional view of the flash light apparatus according to the preferred embodiment of the present invention, illustrating the light source being moved away from the lens.

As shown in FIGS. 2, 3 and 4, the light adjustor 206 comprises a light supporter 208, which is made of conductive material, disposed within the light cavity 106 for supporting the light source 204 and a sleeve actuator 210. The sleeve actuator 210, having a hollow structure, is rotatably and coaxially provided at an outer circumferential surface of the housing 100 at the light cavity 106 thereof.

The light supporter 208 further has a supporting platform 2081 operatively supporting the light source 204 thereat to coaxially align with the lens 202. Furthermore, the sleeve actuator 210 is arranged to drive the light supporter 208 to reciprocatingly move along the longitudinal axis of the housing 100, so as to adjust the distance between the light source 204 and the lens 202.

Accordingly, the illumination angle of the light beam generated from the light source 204 projecting through the lens 202 is able to be selectively adjusted through the longitudinal movement of the light supporter 208, which is supporting the light source 204 thereat, to move frontwardly and backwardly. In other words, a focus between the lens 202 and the light source 204 is adjustable via adjusting the distance therebetween through driving the light supporter 208 by the sleeve actuator 210, so as to adjust the illuminating angles of the light beam to select variety of light patterns, such as a narrower illuminating range as shown in FIG. 4 or a wider illuminating range as shown in FIG. 3.

As mentioned above, the light supporter 208 preferably has an outer threaded portion 209 and the sleeve actuator 210 preferably has an inner threaded portion 211 for engaging with the outer threaded portion 209 of the light supporter 208, so that when the sleeve actuator 210 is rotatably moved to drive the light supporter 208 moving reciprocatingly, the light source 204 is driven to reciprocatingly move toward and away from the lens 202, so as to generate variety of illuminating angles of the light beam. Therefore, through the inner threaded portion 211 of the sleeve actuator 210 driving the outer threaded portion 209 of the light supporter 208 of the light adjustor 206, the distance between the lens 202 and the light source 204 is adjustable without altering the fixed length L of the housing 100. It is worth mentioning that the sleeve actuator 210 is mounted at the housing 100 in a freely rotating manner such that when the sleeve actuator 201 is turned clockwise or counter clockwise with respect to the housing 100, the light source 204 is driven to reciprocatingly move toward and away from the lens 202.

In other words, the sleeve actuator 210 is rotatably moving only in radius direction to drive the light supporter 208 moving in both radius direction and the longitudinal axis direction of the housing 100 through the inner and outer threaded portion 209, 211 of the light supporter 208 and sleeve actuator 211 respectively, so as to adjust the illumination angles in the manner of fixed length L of the housing 100.

It will be readily appreciated by one skilled in the art that the sleeve actuator may also be engaging with the lens 202 or both of the lens 202 and the light supporter 208 supporting the light source 204 thereat for adjusting the distance between the lens 202 and the light source 204. It is worth to mention that the sleeve actuator 210 rotatably engaging with the light supporter 208 not only provides the adjustable illumination angles without altering the fixed length L of the housing 100, but also minimize the total fixed length L of the housing 100 while maximizing the range of variety of illumination angles.

It is worth to mention that the fixed length L of the housing 100 while adjusting the distance between the lens 202 and the light source 204 enables the flash light being stored into the original compartment or bag fittedly for receiving the flash light without adjusting to a minimized distance between the lens 202 and the light source 204, so that a user does not have to re-adjust the distance between the lens 202 and the light source 204 every time they take it out from the flash light bag or compartment.

In the present preferred embodiment, a front blocker 212 is preferably provided to dispose within the light cavity 106 at a rear side of the lens 202 to limit the light supporter 208 being moved forward to the lens 202, so as to prevent the lens 202 being hit by the light source 204. More particularly, the front blocker 212 is preferred to radially and inwardly protruded from a surrounding wall of the light cavity 106 at a front end of the inner threaded portion 211 of the sleeve actuator 210, so that when the light supporter 208 is driven to forwardly move toward the lens, the front blocker 212 is acting as a stopper to prevent the light supporter 208 moving forward to directly contact the light source 204, such as LED, with the lens 202, as best shown in FIG. 3.

In the presently preferred embodiment, the light arrangement 200 further comprises a tubular conductive holder 214 provided to electrically link the power source 300 with the light source 204 for providing electricity to the light source 204 to generate the light beam. The conductive holder 214, which is made of conductive material, is affixed within the power cavity 108 of the housing 100 to electrically contact with the light supporter 208 while contacting with the power source 300 via contacting to a terminal 216 preferably affixed to the conductive holder 214 within power cavity 108 of the housing 100, so as to ensure the light source 204 being electrically connected with the power source 300 when the light source 204 is moving.

Accordingly, the light supporter 208 further comprises a tubular conductor 218 extending rearwardly form a rear side of the light supporter 208 in the light cavity 106 toward the power cavity 108 of the housing 100. More particularly, the tubular conductor 218 is rearwardly extended from the supporting platform 2081 of the light supporter 208. The tubular conductor 218 is able to slidably contact with the tubular conductive holder 214 to ensure the light source 204 supported at the light supporter 208 is electrically connecting with the power source 300. In other words, the tubular conductor 218 extended from the rear side of the light supporter 208 has a predetermined length to ensure that the tubular conductor 218 is able to contact with the conductive holder 214 while the sleeve actuator 210 is being rotatably driven to drive the light supporter 208 moving reciprocatingly for adjusting the illumination angles of the light beam.

Specifically, when the light source 204 is reciprocatingly moved along the longitudinal axis of the housing 100, an outer circumferential surface of the tubular conductor 218 is slidably contacted with an inner circumferential surface of the conductive holder 214 to ensure light source 204 being electrically connected with the power source 300.

In order to ensure the conductive holder 214 and the tubular conductor 218 being slidably and stably contacted with each other, the conductive holder 214 may further has an inner threaded portion 215 formed at the inner circumferential surface thereof to engage with an outer threaded portion 219 of the tubular conductor 218 at the outer circumferential surface thereof, such that when the light supporter 208 is moving reciprocatingly, the tubular conductor 218 is guided to reciprocatingly slide to contact with the conductive holder 214 via the inner and outer threaded portions 215, 219 of the conductive holder 214 and tubular conductor 218 respectively.

It will be appreciated that the conductive holder 214 not only ensures the light supporter 208 being electrically conducted but also stably guides the light supporter 208 to reciprocatingly move along the longitudinal axis of the housing 100 via the threaded portion.

As will be appreciated by one skilled in the art, the inner and outer threaded portions 215, 219 of the conductive holder 214 and the tubular conductor 218 respectively may be interchangeable. In other words, the conductive holder 214 may be engaged with the tubular conductor 218 via an outer threaded portion of the conductive holder 214 engaging with an inner threaded portion of the tubular conductor 218.

Accordingly, a reinforcing ring 220 may be further provided for the conductive holder 214 reinforcing and stably guiding the tubular conductor 218 moving along the axis direction of the housing 100 to electrically connect with the power source 300. The reinforcing ring 200 is preferably affixed at the surrounding wall of the light cavity 106 at a position protruding inwardly and radially therefrom, wherein the reinforcing ring 220 is located between the surrounding wall of the light cavity 106 and the conductive holder 214, such that conductive holder 214 is being held stably in position for guiding the reciprocating movement of the tubular conductor 218, so as to keep contacting therewith.

As best shown in FIGS. 3 and 4, the conductive holder 214 further has a front blocking edge 222 located at a very front end of the conductive holder 214, so that when the light supporter 208 is driven to rearwardly move away from the lens, the front blocking edge 222 is able to limit the light supporter 208 being moved backwardly to the power cavity 108 of the housing 100.

According to the preferred embodiment, the housing 100 has a housing body 11 defining the power cavity 108 therewithin and a front cover 12 defining the front end 102 thereat. The lens 202 is sealed and affixed at the front cover 12 of the housing 100 for reinforcing the lens 202 being supported at the front end 102 of the housing 100.

In order to couple the front cover 12 with the housing body 11, the light arrangement 200 forms an adapter to coaxially link the front cover 12 with the housing body 11. As shown in FIG. 2, the conductive holder 214 is detachably and coaxially coupled at a front end of the housing body 11 while the sleeve actuator 211 is detachably and coaxially coupled with the front cover 12. Accordingly, the light supporter 208 is rotatably coupled within the sleeve actuator 211 in such a manner that when the tubular conductor 218 of the light supporter 208 is rotatably coupled with the conductive holder 214, the front cover 12 is coaxially aligned with the housing body 11. In other words, the light cavity 106 is defined within the sleeve actuator 211 at a position behind the front cover 12.

Therefore, when the light adjustor 206 is being rotatably moved to adjust the distance between the lens 202 and the light source 204, the fixed length L from the rear end 104 of the housing body 11 of the housing 100 to the front cover 12 is remaining the same. In other words, the housing 100 has the fixed length L while the distance between the lens 202 and the light source 204 is changing.

As shown in FIGS. 1 and 2 of the drawings, a switch 224 is further provided for controlling the power of the flash light preferably in an on-and-off manner, wherein the switch 224 is preferably provided at the closed rear end 104 of the housing 100 and electrically connecting with the power source 300 to controllably switching the power of the flash light. A rear cover 226 may further provided at the rear end 104 of the housing 100 to detachably seal the power cavity 108, so as for accessing the power source 300 within the power cavity 108.

As embodied in the present invention, the power source 300 is preferably one or more replaceable batteries being received within the power cavity 108 of the housing 100, so that the batteries are able to be accessed via removing the rear cover 226 to access the power cavity 108.

Accordingly, the switch 224 is preferably provided on the rear cover 226 for being conveniently controlling the switch 224 while holding a rear portion of the housing body 11 of the housing 100. Therefore, when the switch 224 is being pressed to electrically connect with the power source 300 to form a closed circuit between the light source 204, power source 300 and the switch 224, the light beam is generated from the light source 204. Likewise, when the switch 224 is being pressed again, the circuit is disconnected to turn off the power supplied to the light source 204 embodied as LED.

The front cover 12 reinforcing and retaining the lens 202 at the front end 102 of the housing 100 may be detachably coupling with the front end 102, such as via threaded portion at the peripheral edge of the front cover to engage threaded portion of the surrounding wall within the light cavity 106 to spirally or rotationally detach from or attach to the front end 102 of the housing 100, in such a manner that the structure of the light arrangement 200 can be easily assembled and dissembled, so as to easily change the LED or light bulb of light source 204.

Thus, the structure of the conductive holder 214, tubular conductor 218, sleeve actuator 210, light supporter 208, light source 204, and the lens 202 of the light arrangement 200 can be simply assembled via the threaded portions and the detachable arrangements, so as to minimize the manufacturing cost.

The present invention not only can selectively adjust the illumination angles of the light beam without altering the fixed total length of the housing 100, but also provide a durable and stable electrical connection between the power source and the light source to prevent the happing of short-circuit.

One skilled in the art will understand that the embodiment of the present to invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flash light, comprising:

a hollow housing having an open front end, a closed rear end defining a fixed length between said front end and said rear end, a light cavity formed within said front end, and a power cavity formed at said rear end for receiving a power source within said power cavity; and a light arrangement, which comprises:

a lens coaxially supported at said front end of said housing:

a light source, which is a LED, disposed within said light cavity for generating a light beam alignedly towards said lens; and a light adjustor movably coupling with said housing to selectively adjust a distance between said light source and said lens along a longitudinal axis of said housing for adjusting an illumination angle of said light beam without altering said affixed length of said housing, wherein said light adjustor comprises a light supporter disposed within said light cavity to support said light source, and a sleeve actuator which is rotatably and coaxially coupling with an outer circumferential surface of said housing within said light cavity thereof and is arranged to drive said light supporter to reciprocatingly move along said longitudinal axis of said housing so as to selectively adjust said distance between said light source and said lens, wherein said housing further comprises a tubular conductive holder affixed within said power cavity to electrically contact with said light supporter so as to ensure said light source being electrically connected with said power source when said light source is moved, wherein said light supporter comprises a tubular conductor extending rearwardly to slidably contact with said conductive holder, such that when said light source is reciprocatingly moved along said longitudinal axis of said housing, an outer circumferential surface of said tubular conductor is slidably contacted with an inner circumferential surface of said conductive holder to ensure light source being electrically connected with said power source.

2. The flash light, as recited in claim 1, wherein said conductive holder has an inner threaded portion formed at said inner circumferential surface thereof to engage with an outer threaded portion of said tubular conductor at said outer circumferential surface thereof, such that said conductive holder not only ensures said light supporter being electrically conducted but also guides said light supporter to reciprocatingly move along said longitudinal axis of said housing.

3. A flash light, comprising:

a hollow housing having an open front end, a closed rear end defining a fixed length between said front end and said rear end, a light cavity formed within said front end, and a power cavity formed at said rear end for receiving a power source within said power cavity; and a light arrangement, which comprises:

a lens coaxially supported at said front end of said housing:

a light source, which is a LED, disposed within said light cavity for generating a light beam alignedly towards said lens; and a light adjustor movably coupling with said housing to selectively adjust a distance between said light source and said lens along a longitudinal axis of said housing for adjusting an illumination angle of said light beam without altering said affixed length of said housing, wherein said light adjustor comprises a light supporter disposed within said light cavity to support said light source, and a sleeve actuator which is rotatably and coaxially coupling with an outer circumferential surface of said housing within said light cavity thereof and is arranged to drive said light supporter to reciprocatingly move along said longitudinal axis of said housing so as to selectively adjust said distance between said light source and said lens, wherein said light supporter has an outer threaded portion engaging with an inner threaded portion of said sleeve actuator such that when said sleeve actuator is rotated around said housing, said light supporter is driven to rotate so as to reciprocatingly move said light source with respect to said lens, wherein said housing further comprises a front blocker radially and inwardly protruded from a surrounding wall of said light cavity at a front end of said inner threaded portion of said sleeve actuator to limit said light supporter being moved forward to said lens so as to prevent said lens being hit by said light source, wherein said housing further comprises a tubular conductive holder affixed within said power cavity to electrically contact with said light supporter so as to ensure said light source being electrically connected with said power source when said light source is moved, wherein said light supporter comprises a tubular conductor extending rearwardly to slidably contact with said conductive holder, such that when said light source is reciprocatingly moved along said longitudinal axis of said housing, an outer circumferential surface of said tubular conductor is slidably contacted with an inner circumferential surface of said conductive holder to ensure light source being electrically connected with said power source.

4. The flash light, as recited in claim 3, wherein said conductive holder has an inner threaded portion formed at said inner circumferential surface thereof to engage with an outer threaded portion of said tubular conductor at said outer circumferential surface thereof, such that said conductive holder not only ensures said light supporter being electrically conducted but also guides said light supporter to reciprocatingly move along said longitudinal axis of said housing.

5. A flash light, comprising:

a hollow housing having an open front end, a closed rear end defining a fixed length between said front end and said rear end, a light cavity formed within said front end, and a power cavity formed at said rear end for receiving a power source within said power cavity; and a light arrangement, which comprises:

a lens coaxially supported at said front end of said housing:

a light source, which is a LED, disposed within said light cavity for generating a light beam alignedly towards said lens; and a light adjustor movably coupling with said housing to selectively adjust a distance between said light source and said lens along a longitudinal axis of said housing for adjusting an illumination angle of said light beam without altering said affixed length of said housing, wherein said light adjustor comprises a light supporter disposed within said light cavity to support said light source, and a sleeve actuator which is rotatably and coaxially coupling with an outer circumferential surface of said housing within said light cavity thereof and is arranged to drive said light supporter to reciprocatingly move along said longitudinal axis of said housing so as to selectively adjust said distance between said light source and said lens, wherein said light supporter has an outer threaded portion engaging with an inner threaded portion of said sleeve actuator such that when said sleeve actuator is rotated around said housing, said light supporter is driven to rotate so as to reciprocatingly move said light source with respect to said lens, wherein said housing further comprises a front blocker radially and inwardly protruded from a surrounding wall of said light cavity at a front end of said inner threaded portion of said sleeve actuator to limit said light supporter being moved forward to said lens so as to prevent said lens being hit by said light source, wherein said light supporter has a supporting platform operatively supporting said light source thereat to coaxially align with said lens, wherein said housing further comprises a tubular conductive holder affixed within said power cavity to electrically contact with said light supporter so as to ensure said light source being electrically connected with said power source when said light source is moved, wherein said light supporter comprises a tubular conductor extending rearwardly to slidably contact with said conductive holder, such that when said light source is reciprocatingly moved along said longitudinal axis of said housing, an outer circumferential surface of said tubular conductor is slidably contacted with an inner circumferential surface of said conductive holder to ensure light source being electrically connected with said power source.

6. The flash light, as recited in claim 5, wherein said conductive holder has an inner threaded portion formed at said inner circumferential surface thereof to engage with an outer threaded portion of said tubular conductor at said outer circumferential surface thereof, such that said conductive holder not only ensures said light supporter being electrically conducted but also guides said light supporter to reciprocatingly move along said longitudinal axis of said housing.

7. The flash light, as recited in claim 5, wherein said conductive holder further has a front blocking edge to limit said light supporter being moved backward to said power cavity.

8. The flash light, as recited in claim 6, wherein said conductive holder further has a front blocking edge to limit said light supporter being moved backward to said power cavity.

9. The flash light, as recited in claim 5, wherein said housing comprises a front cover for said lens being coaxially sealed and affixed therewithin and a housing body for said conductive holder being coaxially coupled thereto, wherein said sleeve actuator is detachably coupled with said front cover such that when said tubular conductor of said light supporter is rotatably coupled with said conductive holder, said front cover is coaxially aligned with said housing body.

10. The flash light, as recited in claim 8, wherein said housing comprises a front cover for said lens being coaxially sealed and affixed therewithin and a housing body for said conductive holder being coaxially coupled thereto, wherein said sleeve actuator is detachably coupled with said front cover such that when said tubular conductor of said light supporter is rotatably coupled with said conductive holder, said front cover is coaxially aligned with said housing body.

* * * * *